US007268657B2

(12) United States Patent
Yamasaki et al.

(10) Patent No.: US 7,268,657 B2
(45) Date of Patent: Sep. 11, 2007

(54) COIL COMPONENT

(75) Inventors: Hitoshi Yamasaki, Ibaraki (JP); Takumi Kamisaki, Toyooka (JP)

(73) Assignee: Matsushita Electric Industrial Co., Ltd, Osaka (JP)

( * ) Notice: Subject to any disclaimer, the term of this patent is extended or adjusted under 35 U.S.C. 154(b) by 0 days.

(21) Appl. No.: 11/315,311

(22) Filed: Dec. 23, 2005

(65) Prior Publication Data

US 2006/0097837 A1 May 11, 2006

(51) Int. Cl.
*H01F 27/28* (2006.01)
*H01F 27/24* (2006.01)

(52) U.S. Cl. ..... 336/180; 336/212; 336/182; 336/208

(58) Field of Classification Search ..... 336/180–182, 336/212, 208, 198, 192
See application file for complete search history.

(56) References Cited

U.S. PATENT DOCUMENTS 4,547,705 A * 10/1985 Hirayama et al. ..... 315/219
4,887,061 A * 12/1989 Matsumura ..... 336/178
6,611,190 B2 * 8/2003 Chui et al. ..... 336/198
6,650,218 B1 * 11/2003 Fushimi ..... 336/178
6,876,161 B2 * 4/2005 Chung ..... 315/368.28

FOREIGN PATENT DOCUMENTS

JP 2003-22917 A 1/2003

* cited by examiner

*Primary Examiner*—Anh Mai
(74) *Attorney, Agent, or Firm*—Steptoe & Johnson LLP

(57) ABSTRACT

The coil component of the present invention is configured in that one secondary winding is coiled between central portion and end portion of outer magnetic leg, and the other secondary winding is coiled between central portion of outer magnetic leg and first gap portion. Secondary windings and are coil in directions opposite to each other, and secondary winding is less in the number of windings than secondary winding.

7 Claims, 9 Drawing Sheets

COIL COMPONENT

BACKGROUND OF THE INVENTION

1. Field of the Invention

The present invention relates to a coil component for voltage transformation which is used in various electronic apparatuses.

2. Background Art

A conventional coil component will be described in the following with reference to the drawings.

FIG. 10 is an exploded perspective view of a conventional coil component. FIG. 11 is a perspective view of the coil component.

In FIG. 10 and FIG. 11, a conventional coil component comprises closed magnetic circuit core 1, primary bobbin 3 and secondary bobbin 5 built into the closed magnetic core 1. And, primary bobbin 3 has primary winding 2 coiled in groove 8, and a primary winding terminal (not shown) is planted in primary bobbin 3, and one end of primary winding 2 is connected thereto. Also, secondary bobbin 5 has primary winding 4 coiled in groove 8, and low potential terminal 6 is planted in secondary bobbin 5, and one end of secondary winding 4 is connected thereto. Further, high potential terminal 7 is planted in secondary bobbin 5, and the other end of secondary winding 4 is connected to high potential terminal 7.

Closed magnetic circuit core 1 has middle magnetic leg 10 and outer magnetic leg 11 disposed on opposing plate-like back magnetic leg 9. Two back magnetic legs 9 are arranged in parallel with each other in such manner as to sandwich the middle magnetic leg 10. And, one outer magnetic leg 11 is a rectangular magnetic leg, and the other outer magnetic leg 11 is formed of two cylindrical magnetic legs. One outer magnetic leg 11 (rectangular magnetic leg) of closed magnetic circuit core 1 is combined with primary bobbin 3, and the other two outer magnetic legs 11 (cylindrical magnetic legs) are combined with secondary bobbin 5. And, middle magnetic leg 10 is not combined with anything but provided with a gap (not shown) between it and one back magnetic leg 9.

A coil component having such a configuration is used, for example, as an inverter transformer for back light of a liquid crystal monitor or the like. And, a straight-tube discharge lamp is connected to low potential terminal 6 connected to one end of secondary winding 4 and to high potential terminal 7 connected to the other end (totaling two straight-tube discharge lamps are connected to two secondary windings 4).

As the information of prior art document related to this invention, for example, Japanese Laid-open Patent 2003-22917 is commonly known.

In the above configuration, the shapes of two outer magnetic legs 11 disposed in such manner as to sandwich the middle magnetic leg 10 are different from each other, that is, one outer magnetic leg 11 is rectangular, and the other magnetic leg 11 is cylindrical. At the same time, since one outer magnetic leg 11 and the other outer magnetic leg 11 are spaced apart from each other, magnetic flux generated from one outer magnetic leg 11 is hard to equally flow to two outer magnetic legs 11 (and it is liable to become unbalanced). Accordingly, there arises a problem that it is difficult to equalize and stabilize the output voltages of two secondary windings 4 because of the structure of closed magnetic circuit core 1.

SUMMARY OF THE INVENTION

The coil component of the present invention comprises a closed magnetic core having a pair of outer magnetic legs and a pair of back magnetic legs connected to the outer magnetic legs, a primary winding coiled on one outer magnetic leg, two secondary windings coiled on the other outer magnetic leg, and a terminal connected to the primary winding and secondary winding, wherein the other outer magnetic leg is provided with a first gap portion at one back magnetic leg side, while one secondary winding is coiled between the central portion and end portion of the outer magnetic leg, and the other secondary winding is coiled between the central portion and the first gap portion of the outer magnetic leg. At the same time, one secondary winding and the other secondary winding are coiled in directions opposite to each other, and the one secondary winding is less in the number of windings than the other secondary winding.

DETAILED DESCRIPTION OF THE INVENTION

FIRST EXEMPLARY EMBODIMENT

A coil component in the first exemplary embodiment of the present invention will be described in the following with reference to the drawings.

Figure 1:
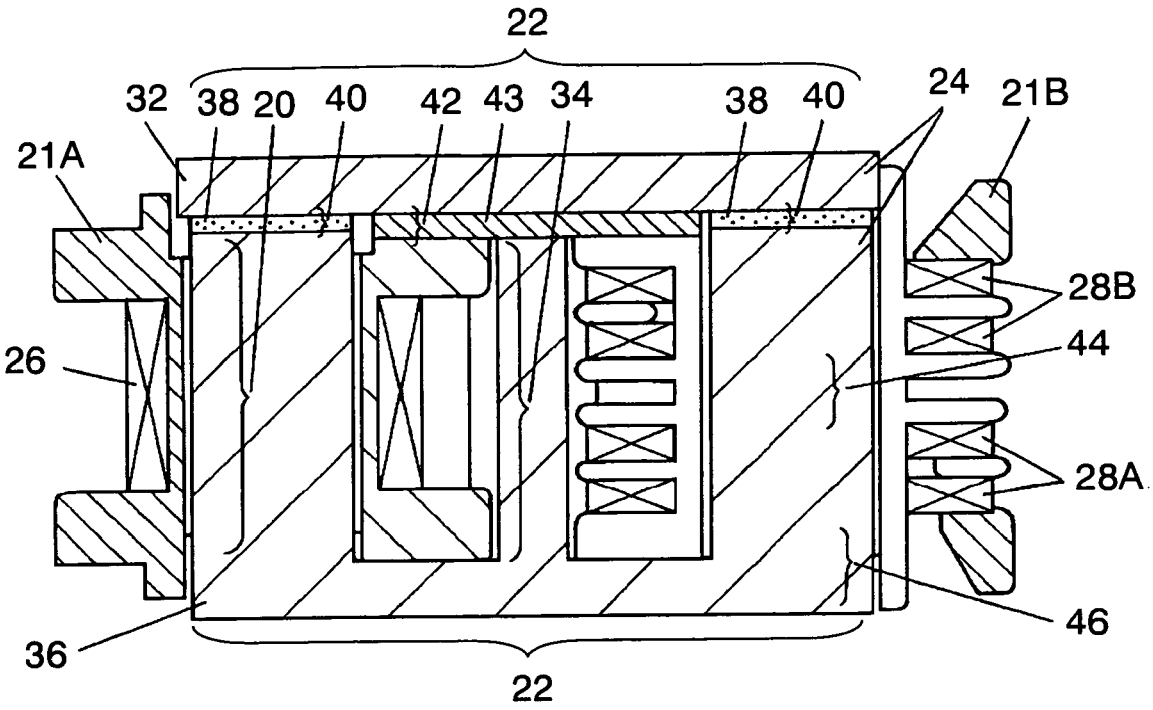
FIG. 1 is a sectional view of a coil component in the first exemplary embodiment of the present invention.
Figure 2:
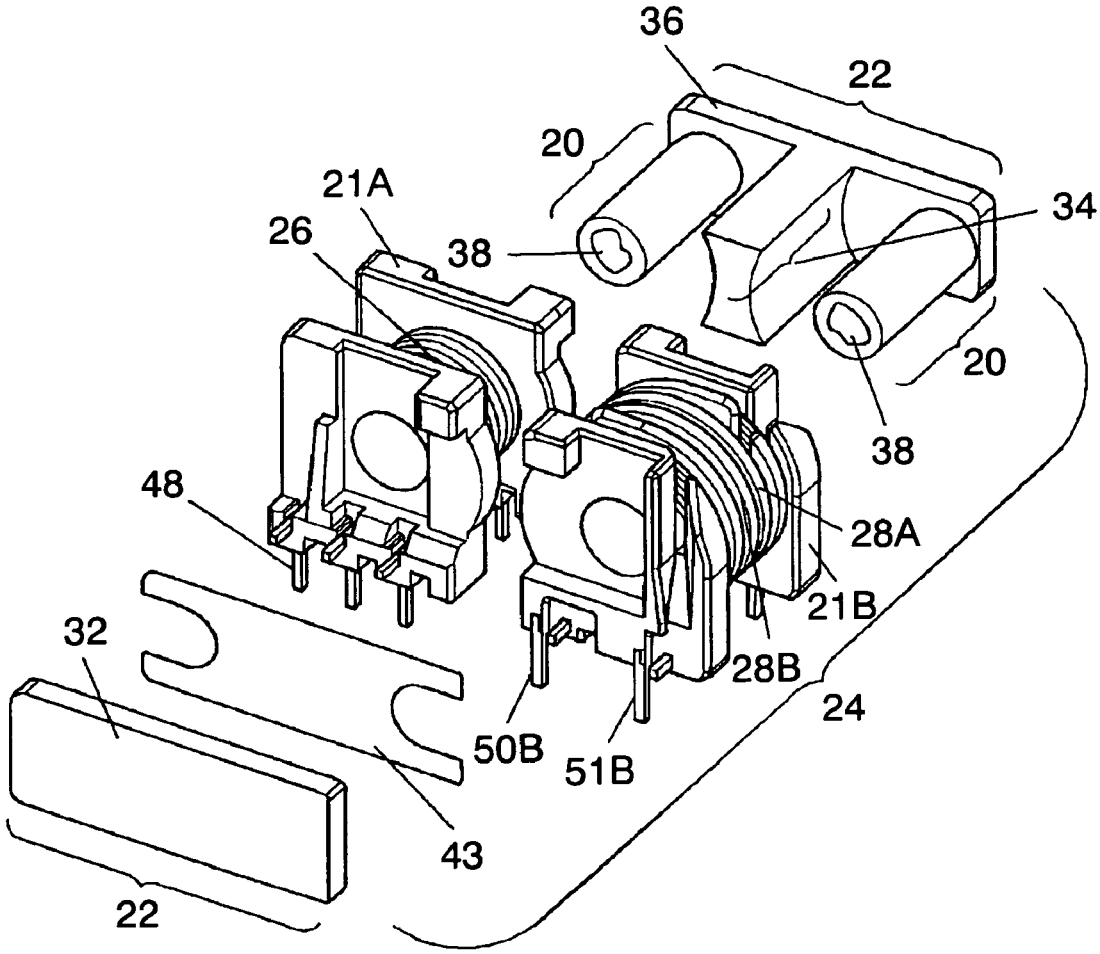
FIG. 2 is an exploded perspective view of the coil component in FIG. 1.
Figure 3:
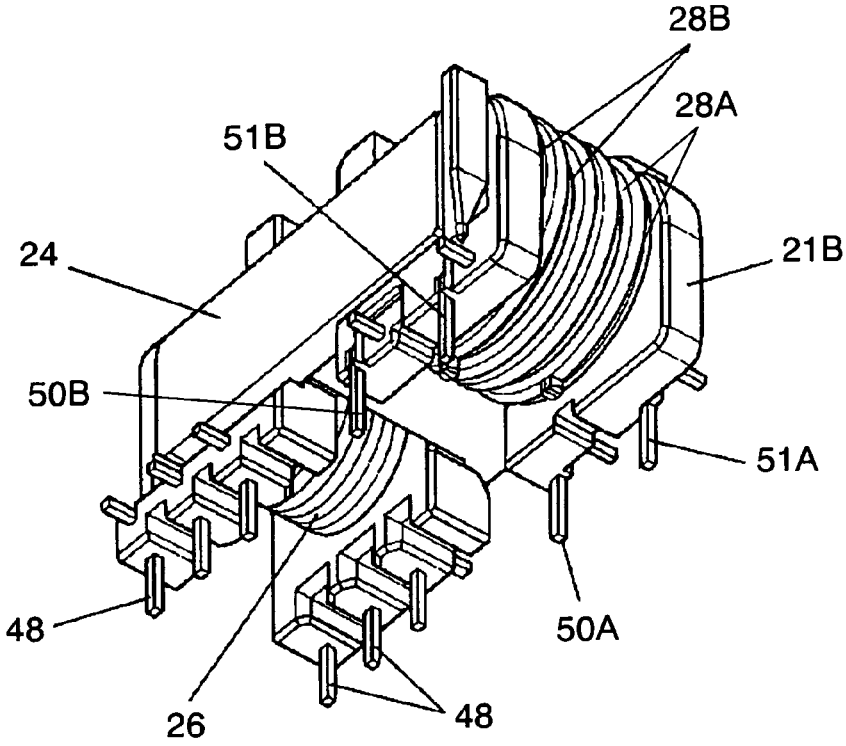
FIG. 3 is a bottom perspective view of the coil component in FIG. 1.
Figure 4:
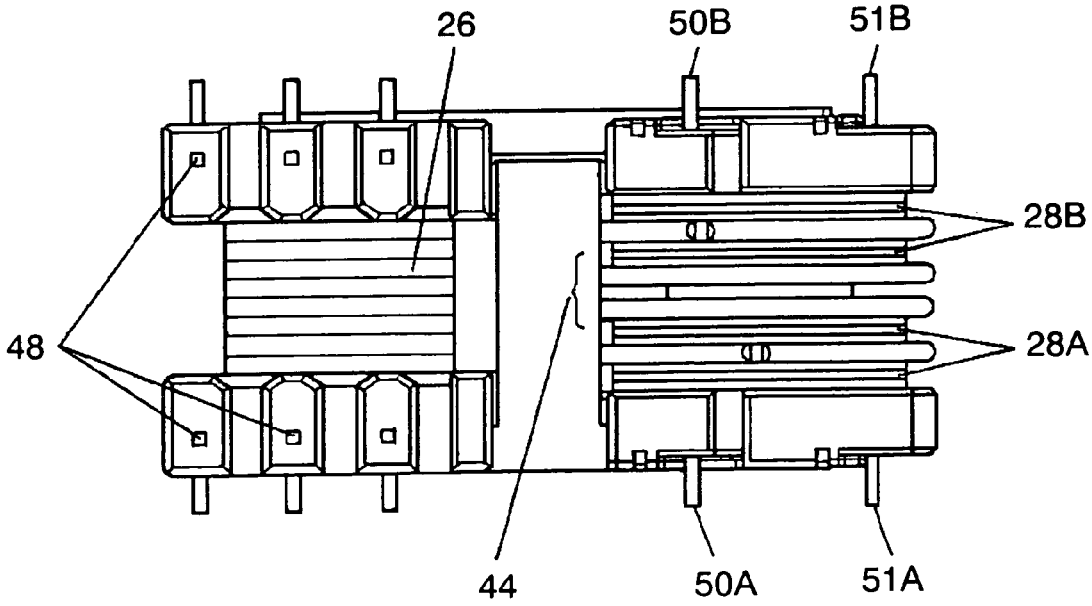
FIG. 4 is a bottom view of the coil component in FIG. 1.

FIG. 1 is a sectional view of a coil component in the first exemplary embodiment of the present invention. FIG. 2 is an exploded perspective view of the coil component shown in FIG. 1. FIG. 3 is a bottom perspective view of the coil component shown in FIG. 1. FIG. 4 is a bottom view of the coil component shown in FIG. 1. FIG. 5 is a top perspective view of the component shown in FIG. 1.

In FIG. 1 to FIG. 5, a coil component in the first exemplary embodiment of the present invention comprises closed magnetic circuit core 24 having a pair of outer magnetic legs 20 and a pair of back magnetic legs 22 connected to the outer magnetic leg 20. And, the coil component comprises primary winding 26 coiled on one outer magnetic leg 20 via bobbin 21A, two secondary windings 28A, 28B coiled on the other outer magnetic leg 20 via bobbin 21B. Further, the coil component comprises a terminal connected to these primary winding 26 and secondary windings 28A, 28B.

The closed magnetic circuit core 24 is formed of I-shaped split magnetic core 32 and E-shaped split magnetic core 36 which are abutted and combined with each other via adhesive agent 38 in a direction nearly horizontal to the mounting surface. And, E-shaped split magnetic core 36 has middle magnetic leg 34 between a pair of outer magnetic legs 20, and each outer magnetic leg 20 and middle magnetic leg 34 are nearly equal in sectional area. The other outer magnetic leg 20 (outer magnetic leg 20 with two secondary windings 28 coiled thereon) of E-shaped split magnetic core 36 is provided with first gap portion 40 at one back magnetic leg 22 side (I-shaped split magnetic core 32 side). At the same time, there is provided second gap portion 42 between I-shaped split magnetic core 32 and middle magnetic leg 34. First gap portion 40 is formed by adhesive agent 38 used for combining I-shaped split magnetic core 32 with E-shaped split magnetic core 36, and second gap portion 42 is formed by inserting gap paper 43 therein.

Also, one secondary winding 28A is coiled between end portion 46 of outer magnetic leg 20 disposed more apart from first gap portion 40 and central portion 44 of outer magnetic leg 20. Also, the other secondary winding 28B is coiled between first gap portion 40 and central portion 44 of outer magnetic leg 20. In this case, secondary windings 28A and 28B are coiled in directions opposite to each other, and secondary winding 28A is less in the number of windings than secondary winding 28B. Particularly, both of secondary windings 28A and 28B are coiled in a direction from the back magnetic leg 22 side of outer magnetic leg 20 to the central portion 44 side, and secondary windings 28A, 28B are high potential at the back magnetic leg 22 side and low potential at the central portion 44 side.

Further, bobbin 21A disposed at one outer magnetic leg 20 includes primary winding terminal 48 planted for the purpose of connection to primary winding 26. Also, bobbin 21B disposed at the other outer magnetic leg 20 includes low potential terminals 50A, 50B planted at the middle magnetic leg 34 side for the purpose of connection to secondary windings 28A, 28B, and also high potential terminals 51A, 51B planted at the side opposite to middle magnetic leg 34. And, one end of secondary winding 28A is led out from the central portion 44 side of outer magnetic leg 20 and connected to low potential terminal 50A. At the same time, the other end of secondary winding 28A is led out from the back magnetic leg 22 side of outer magnetic leg 20 and connected to high potential terminal 51A. One end of secondary winding 28B is led out from the central portion 44 side of outer magnetic leg 20 and connected to low potential terminal 50B. At the same time, the other end of secondary winding 28B is led out from the back magnetic leg 22 side of outer magnetic leg 20 and connected to high potential terminal 51B.

In the above configuration, secondary winding 28A is coiled between end portion 46 of outer magnetic leg 20 disposed more apart from first gap portion 40 and central portion 44 of outer magnetic leg 20. Also, secondary winding 28B is coiled between first gap portion 40 and central portion 44 of outer magnetic leg 20. And, secondary windings 28A and 28B are coiled in directions opposite to each other, and secondary winding 28A is less in the number of windings than secondary winding 28B. Accordingly, due to the arrangement of primary winding 26 and secondary windings 28A, 28B, the magnetic flux generated from primary winding 26 is uniformly and reliably induced to secondary windings 28A, 28B, and it is possible to equalize and stabilize the output voltages of secondary windings 28A, 28B.

Particularly, since secondary winding 28A is less in the number of windings than secondary winding 28B, the difference in leakage flux of secondary windings 28A and 28B can be reduced and it is possible to prevent the output voltage from becoming unequal due to the difference in leakage flux. In this way, it is possible to suppress the variation of output voltages of secondary windings 28A, 28B with respect to the load circuits connected to two secondary windings 28A, 28B. Accordingly, for example, when the load circuit is a fluorescent tube or the like, it is possible to make all fluorescent tubes nearly equal in brightness, preventing a problem such that one fluorescent tube is bright and the other fluorescent tube is dark.

Also, secondary windings 28A, 28B is high potential at the paired back magnetic legs 22 side and low at the central portion 44 side. Therefore, when secondary windings 28A, 28B are coiled, the low potential portion and high potential portion of secondary windings 28A, 28B do not cross each other under secondary windings 28A, 28B. And, secondary windings 28A, 28B can be led and it is possible to suppress short-circuiting at the low potential portion and high potential portion of secondary windings 28.

Particularly, bobbin 21B is provided with low potential terminals 50A, 50B planted at one outer magnetic leg 20 side and with high potential terminals 51A, 51B planted at the side opposite to one outer magnetic leg 20. And, one end of secondary winding 28A (28B) at the central portion 44 side is connected to low potential terminal 50A (50B), while the other end of secondary winding 28A (28B) at the back magnetic leg 22 side is connected to high potential terminal 51A (51B). Accordingly, the low potential portion and high potential portion of secondary winding 28A (28B) do not cross each other. Also, secondary winding 28A (28B) can be easily connected to both of low potential terminal 50A (50B) and high potential terminal 51A (51B), and it is possible to suppress short-circuiting at the low potential portion and high potential portion of secondary winding 28. In this case, since low potential terminal 50A (50B) and high potential terminal 51A (51B) are spaced apart from each other, short-circuiting between these terminals can be reliably suppressed.

Further, closed magnetic circuit core 24 has I-shaped split magnetic core 32 and E-shaped split magnetic core 36 combined in a direction nearly horizontal to the mounting surface, and also includes second gap portion 42 between I-shaped split magnetic core 32 and middle magnetic leg 34, and it is possible to suppress magnetic saturation.

Figure 5A:
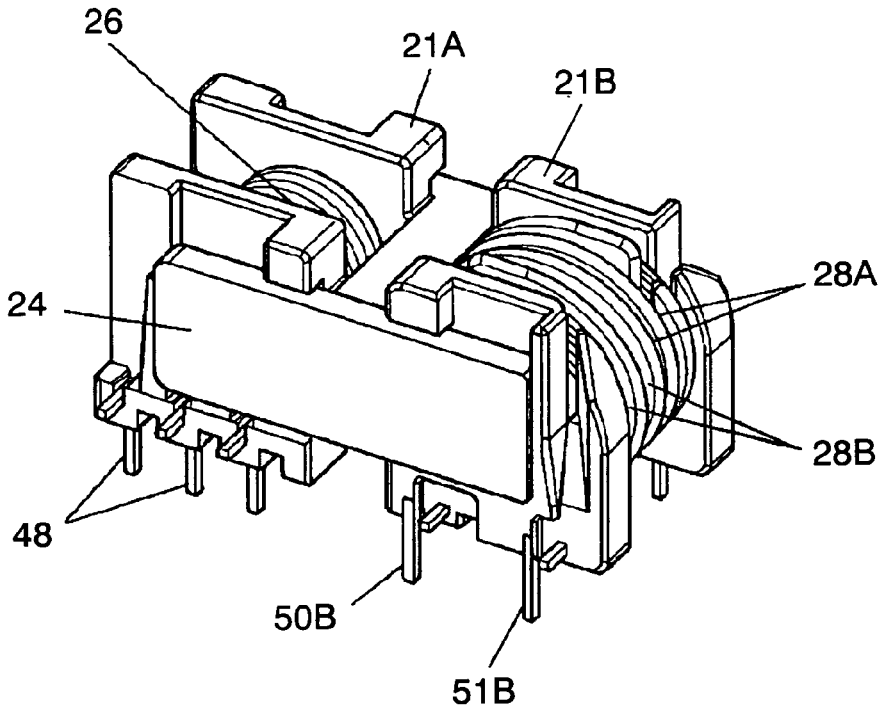
FIG. 5A is a top perspective view of the coil component in FIG. 1.
Figure 5B:
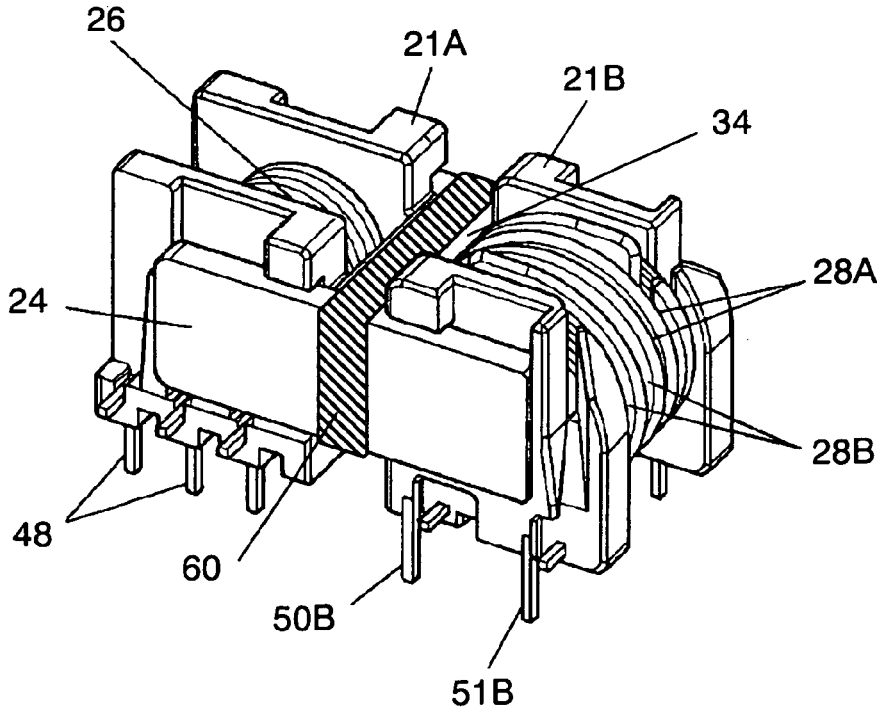
FIG. 5B is a top perspective view of the coil component with a metallic foil in FIG. 5A.

FIG. 5B is a top perspective view of the coil component with a metallic foil in FIG. 5A. As shown in FIG. 5B, there is provided metallic foil 60 around middle magnetic leg 34 so as to surround the second gap portion 42. Hence, by using the construction, a leakage magnetic flux emmited outside from the coil component can be decreased.

SECOND EXEMPLARY EMBODIMENT

Figure 6:
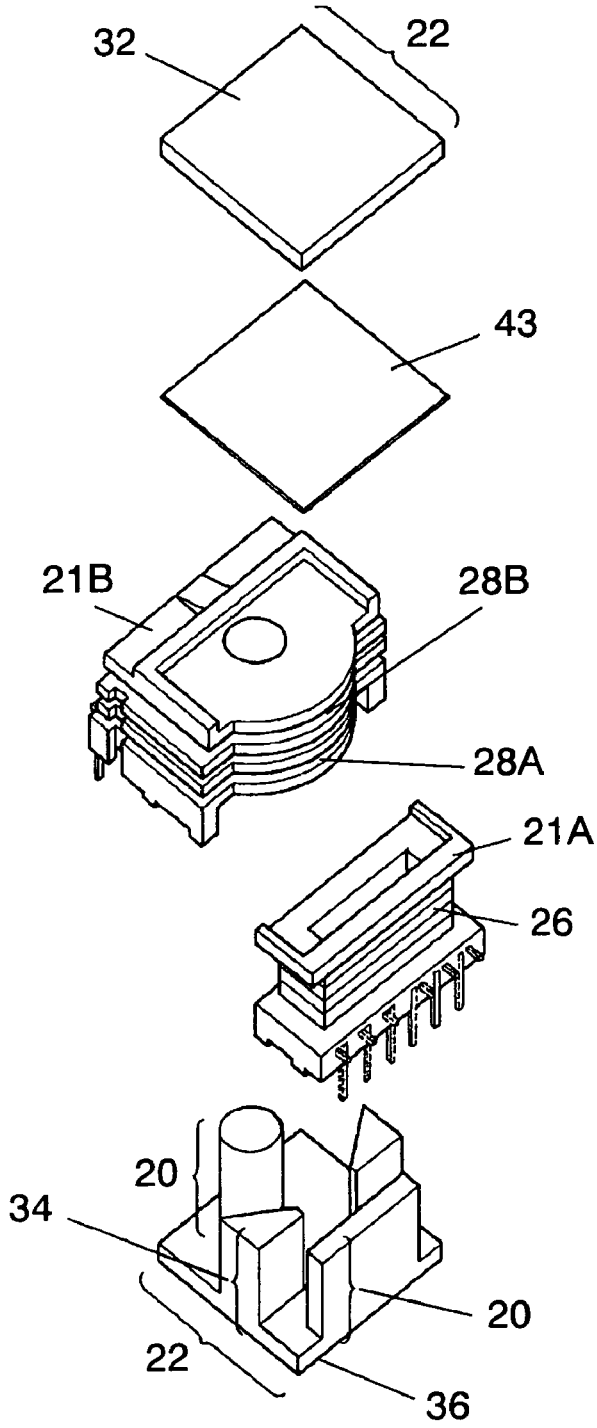
FIG. 6 is an exploded perspective view of a coil component in the second exemplary embodiment of the present invention.
Figure 7:
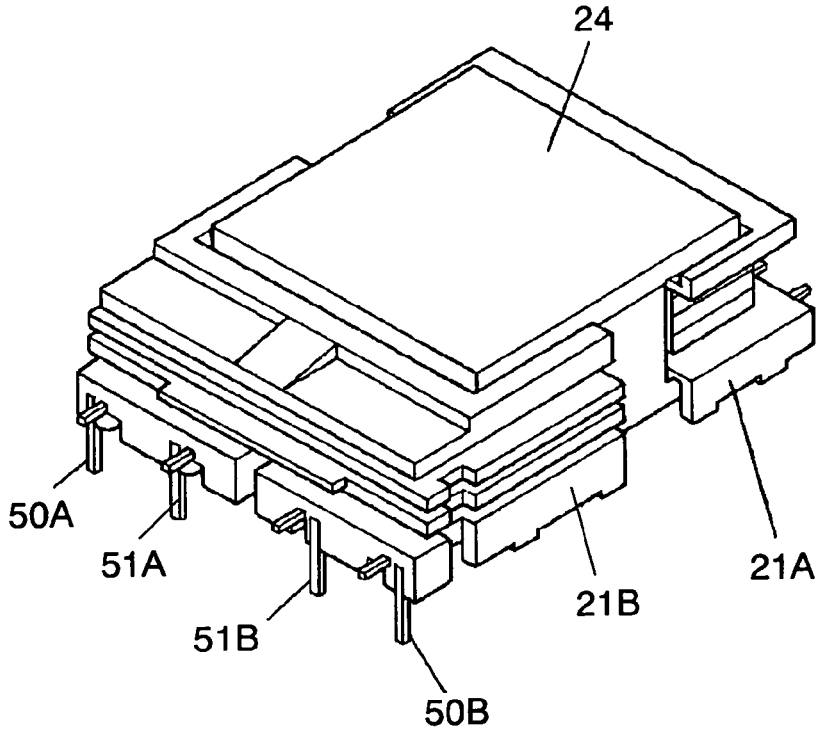
FIG. 7 is a top perspective view of the coil component in FIG. 6.
Figure 8:
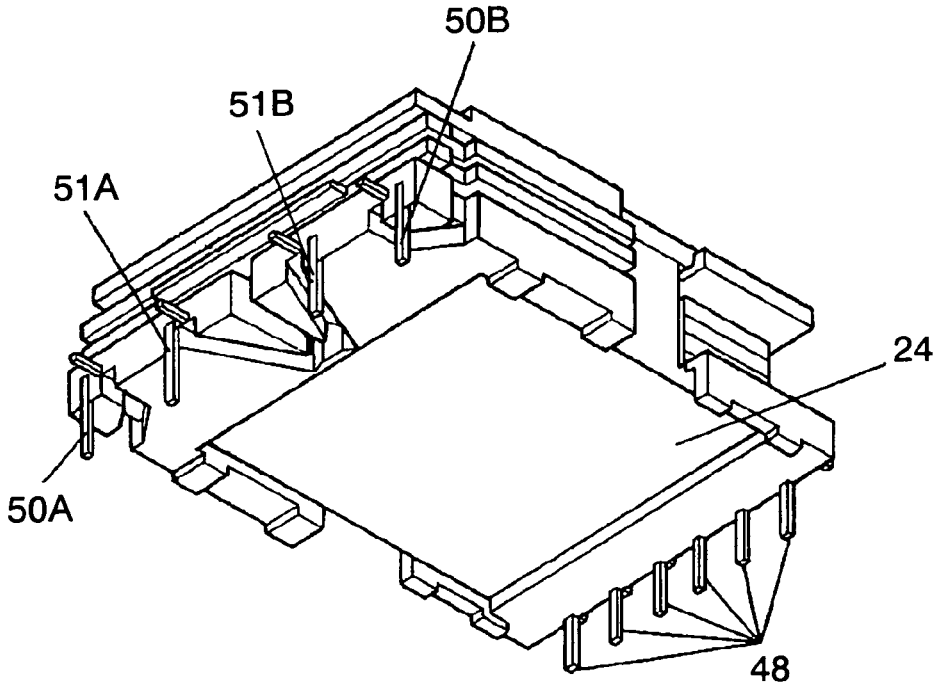
FIG. 8 is a bottom perspective view of the coil component in FIG. 6.
Figure 9:
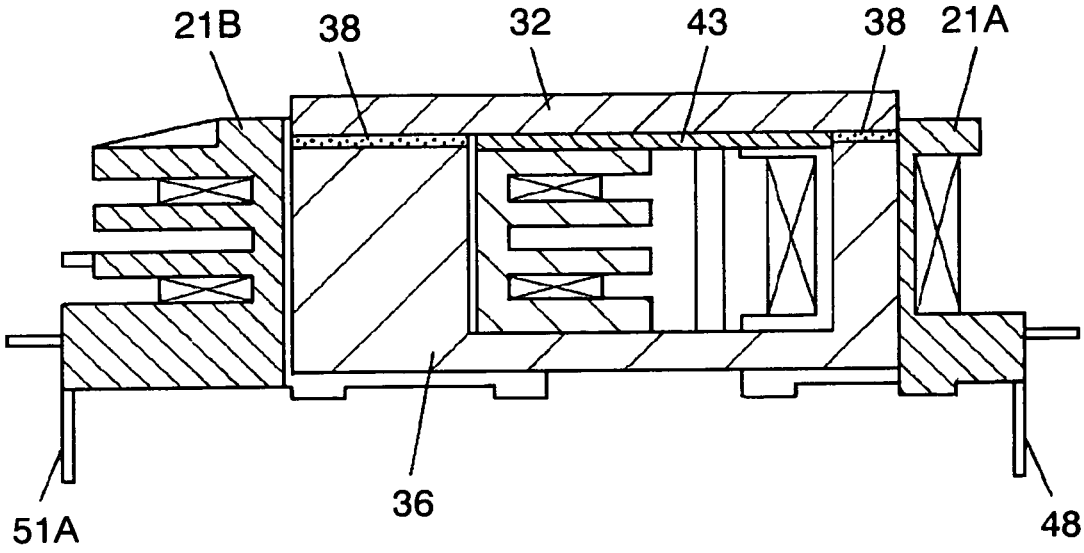
FIG. 9 is a sectional view of the coil component in FIG. 6.
Figure 10:
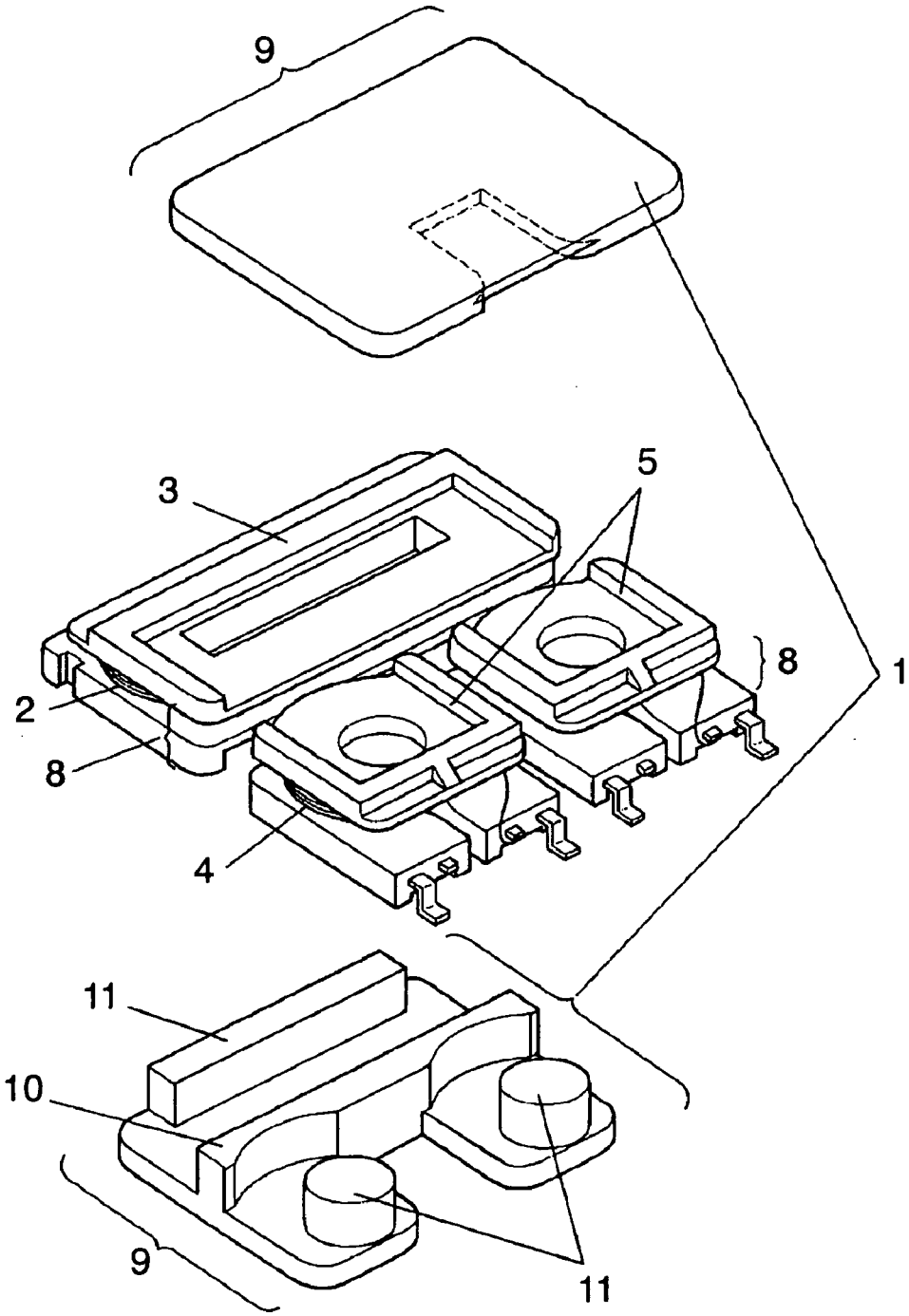
FIG. 10 PRIOR ART
FIG. 10 is an exploded perspective view of a conventional coil component.
Figure 11:
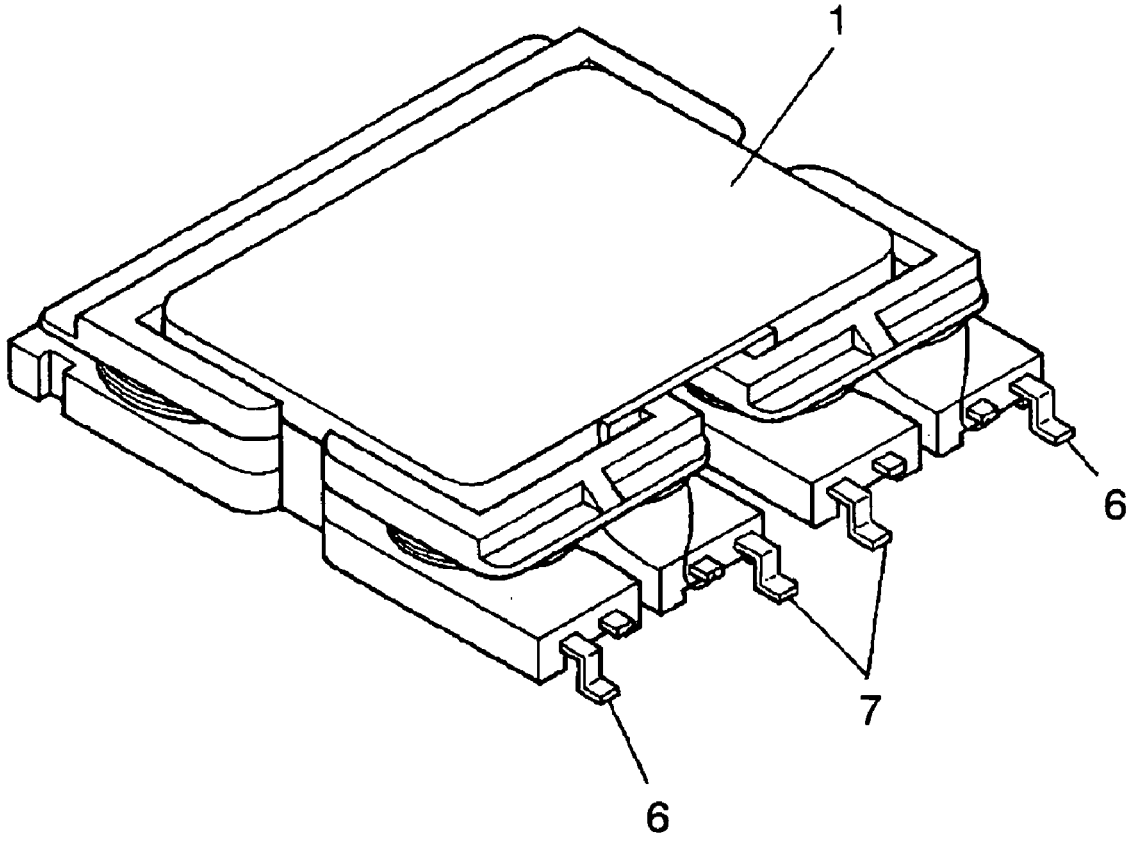
FIG. 11 PRIOR ART
FIG. 11 is a perspective view of the conventional coil component.

FIG. 6 is an exploded perspective view of a coil component in the second exemplary embodiment of the present invention. FIG. 7 is a top perspective view of the coil component shown in FIG. 6. FIG. 8 is a bottom perspective view of the coil component shown in FIG. 6. FIG. 9 is a sectional view of the coil component shown in FIG. 6.

In a transformer in the second exemplary embodiment of the present invention as shown in FIG. 6 to FIG. 9, same effects as in the first exemplary embodiment can be obtained.

That is, the transformer in the second exemplary embodiment of the present invention is different from the transformer in the first exemplary embodiment especially in that I-shaped split magnetic core 32 and E-shaped split magnetic core 36 are abutted each other via adhesive agent 38 in a direction nearly vertical to the mounting surface. In this case, two secondary windings 28A, 28B coiled on outer magnetic leg 20 of E-shaped split magnetic core 36 are disposed in a direction nearly vertical to the mounting surface, and therefore, secondary windings 28A, 28B are coiled in such manner that the low potential portion and high potential portion of secondary windings 28A, 28B do not cross each other. Accordingly, low potential terminals 50A, 50B and high potential terminals 51A, 51B planted in bobbin 21B are disposed so that high potential terminals 51A, 51B are positioned inwardly of low potential terminals 50A, 50B.

It is preferable to connect secondary winding 28A (28B) to low potential terminal 50 A (50B) and high potential terminal 51A (51B), and secondary winding 28B (28A) to low potential terminal 50B (50A) and high potential terminal 51B (51A). It is of course possible to obtain similar effects.

As described above, the coil component of the present invention is capable of equalizing and stabilizing the output voltages of two secondary windings, and applicable for a transformer used in various electronic apparatuses.

What is claimed is:

1. A coil component comprising:

a closed magnetic circuit core having a pair of outer magnetic legs and a pair of back magnetic legs connected to the outer magnetic legs; a primary winding coiled on one outer magnetic leg; two secondary windings coiled on other outer magnetic leg; and terminals connecting the primary winding and the secondary windings, wherein the other outer magnetic leg is provided with a first gap portion at the one back magnetic leg side, one secondary winding is coiled between a central portion and end portion of the outer magnetic leg, while other secondary winding is coiled between the central portion of the outer magnetic leg and the first gap portion, and the one secondary winding and the other secondary winding are coiled in directions opposite to each other, and the one secondary winding has fewer windings than the other secondary winding.

2. The coil component of claim 1, wherein the one secondary winding and the other secondary winding are coiled from the back magnetic leg side of the outer magnetic leg toward the central portion side, and the secondary winding is high potential at the back magnetic leg side and low potential at the central portion side.

3. The coil component of claim 1, wherein the magnetic core has an I-shaped split magnetic core and an E-shaped split magnetic core having a middle magnetic leg between a pair of the outer magnetic legs which are combined in a direction nearly horizontal to the mounting surface, and also, a second gap portion is formed between the I-shaped split magnetic core and the middle magnetic leg.

4. The coil component of claim 3, wherein a metallic foil is disposed around the middle magnetic leg in such manner as to surround the second gap portion.

5. The coil component of claim 3, wherein each of the one and the other outer magnetic legs and the middle magnetic leg are nearly equal in sectional area.

6. The coil component of claim 1, wherein a bobbin is disposed at the other outer magnetic leg, and the bobbin is provided with a low potential terminal planted at the one outer magnetic leg and with a high potential terminal planted at the side opposite to the one outer magnetic leg, and one end portion of the secondary winding is led from the central portion side of the outer magnetic leg and connected to the low potential terminal, while the other end portion of the secondary winding is led from the back magnetic leg side of the outer magnetic leg and connected to the high potential terminal.

7. A coil component with a closed magnetic circuit core, the coil component comprising:

first and second outer magnetic legs;

first and second back magnetic legs;

a primary winding coiled on the first outer magnetic leg;

a first secondary winding coiled on a first half of the second outer magnetic leg;

a second secondary winding coiled on a second half of the second outer magnetic leg; and terminals connecting the primary winding and the first and second secondary windings, wherein ends of the second back magnetic legs, respectively, are integrally connected to first ends of the first outer magnetic leg and the second outer magnetic leg, respectively, wherein each of the first and second outer magnetic legs comprises a first gap portion located on a second end of the first and second outer magnetic legs, the first gap portion connecting the first back magnetic leg to the second ends of the first and second outer magnetic legs, wherein the first secondary winding and the second secondary winding are coiled in opposite directions to each other, and a number of windings in the first secondary winding is greater than a number of windings in the second secondary winding.

* * * * *